US005742882A

United States Patent [19]

Lee

[11] Patent Number: 5,742,882

[45] Date of Patent: Apr. 21, 1998

[54] ELECTROPHOTOGRAPHIC IMAGE FORMING DEVICE WITH AUGERS FOR TRANSFERRING TONER

[75] Inventor: Man-Woo Lee, Suwon, Rep. of Korea

[73] Assignee: SamSung Electronics Co., Ltd., Suwon, Rep. of Korea

[21] Appl. No.: 686,963

[22] Filed: Jul. 26, 1996

[30] Foreign Application Priority Data

Jul. 29, 1995 [KR] Rep. of Korea ..... 23095

[51] Int. Cl.[6] ..... G03G 15/08; G03G 21/12

[52] U.S. Cl. ..... 399/258; 399/359

[58] Field of Search ..... 399/254, 255, 399/258, 260, 262, 263, 358, 359

[56] References Cited

U.S. PATENT DOCUMENTS

| | | | |
|---|---|---|---|
| 4,894,688 | 1/1990 | Taniguchi et al. | 399/359 |
| 5,030,988 | 7/1991 | Haneda et al. | 399/358 X |
| 5,146,270 | 9/1992 | Matsuo et al. | 399/358 X |
| 5,177,322 | 1/1993 | Nishimura et al. | 399/222 |
| 5,200,787 | 4/1993 | Nishiguchi | 399/359 |
| 5,253,019 | 10/1993 | Brewington et al | 399/281 |
| 5,270,782 | 12/1993 | Floyd, Jr. | 399/281 |
| 5,274,426 | 12/1993 | Goseki et al. | 399/276 |
| 5,305,064 | 4/1994 | Trott et al. | 399/258 |
| 5,592,267 | 1/1997 | Misago et al. | 399/359 X |

*Primary Examiner*—William J. Royer
*Attorney, Agent, or Firm*—Robert E. Bushnell, Esq.

[57] ABSTRACT

An electrophotographic image forming device includes a toner container installed inside a photoconductive drum to provide toner to a developing unit. Toner that is removed and collected by a cleaning unit can be reused, thus reducing toner cost. Also, since the toner container is installed inside the photoconductive drum, the image forming device can be made compact, and an installation space is not restricted when the developing unit is installed within the image forming device. Further, since the used toner is re-used, the interior portions of the image forming device are not contaminated.

14 Claims, 4 Drawing Sheets

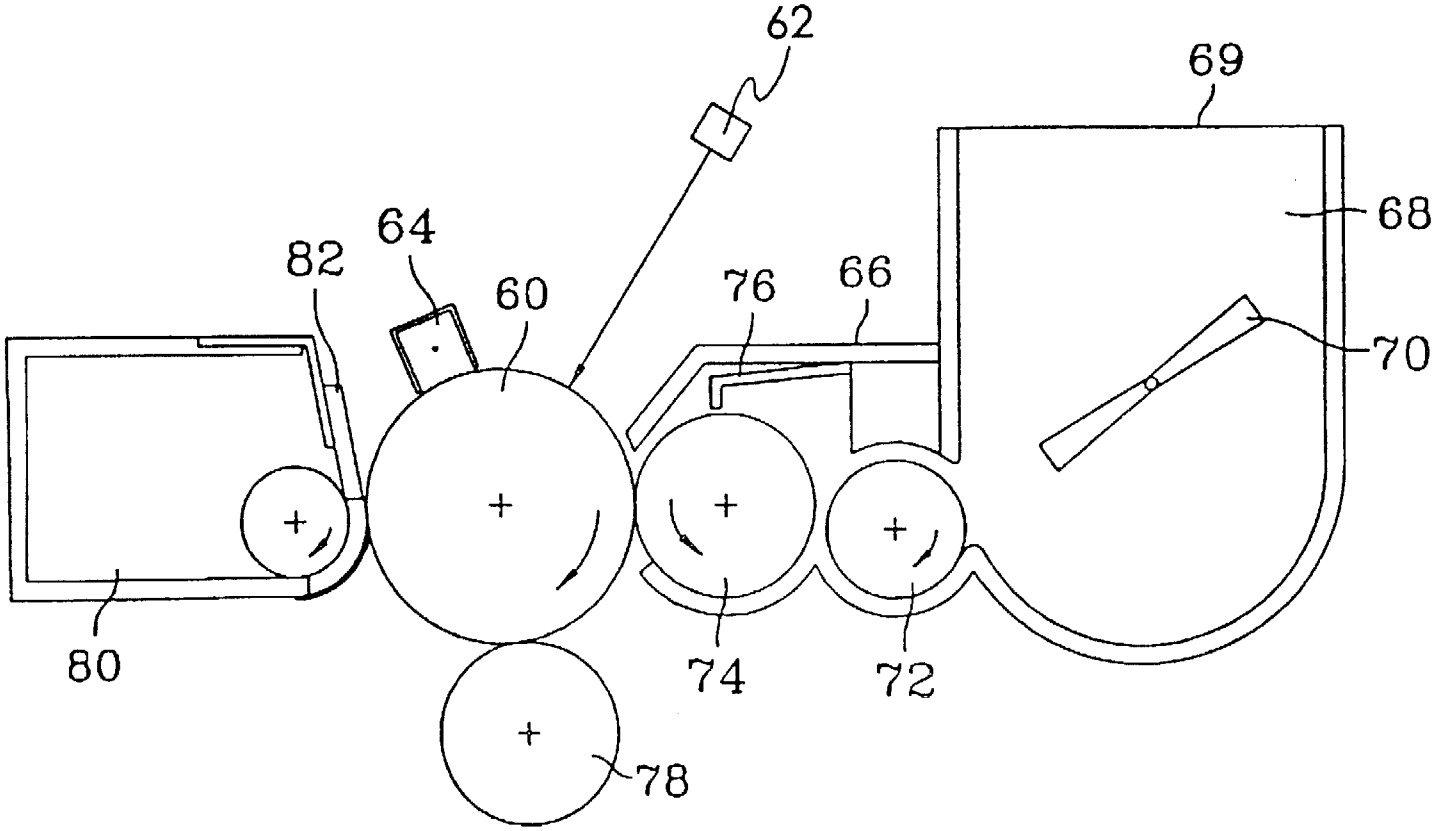
Fig. 1 CONVENTIONAL

ELECTROPHOTOGRAPHIC IMAGE FORMING DEVICE WITH AUGERS FOR TRANSFERRING TONER

CROSS-REFERENCE TO RELATED APPLICATIONS

This application makes reference to, incorporates the same herein, and claims all benefits accruing under 35 U.S.C. §119 arising from an application for Electrophotographic Image Forming Device earlier filed in the Korean Industrial Property Office on 29 Jul. 1995 and there duly assigned Ser. No. 23095/1995.

BACKGROUND OF THE INVENTION

The present invention relates to an electrophotographic image forming device, such as a laser beam printer, copying machine and facsimile, and more particularly, to an electrophotographic image forming device in which a toner container is installed within a photoconductive drum to provide toner to a developing unit.

In an electrophotographic image forming device, a photoconductive member is charged to a uniform potential, and the charged portion of the photoconductive member is exposed to a light image of an original document being reproduced. This creates an electrostatic latent image corresponding to the document image on the photoconductive member. After the electrostatic latent image is formed on the photoconductive member, the latent image is developed by bringing developing material, typically toner, into contact with the latent image. This forms a developed image of the original document on the photoconductive member which is subsequently transferred to a recording sheet. The recording sheet bearing the document image is then treated with heat and pressure to permanently affix the image upon the recording sheet.

In this well-known image forming operation, proper transfer and handling of developing material is a key element. If the developing material is not properly handled, problems such as contamination can adversely affect the operation of the image forming device. Many prior art references, such as U.S. Pat. Nos. 5,177,322, 5,253,019, 5,270,782, 5,274,426 and 5,305,064 discuss the issue of handling developing material. In assessing the prior art, I believe that an innovative and improved means for handling developing material in an electrophotographic image forming device can be contemplated.

SUMMARY OF THE INVENTION

Therefore, it is an object of the present invention to provide an improved electrophotographic image forming device.

It is another object to provide an electrophotographic image forming device having a toner storage container installed within the interior of a photoconductive drum.

It is still another object to provide an electrophotographic image forming device in which toner that is removed and collected by a cleaning unit can be re-used.

It is yet another object to provide an electrophotographic image forming device having a compact structure so that is it not restricted by an installation space.

It is still yet another object to provide an electrophotographic image forming device that is resistant to internal contamination by toner.

These and other objects can be achieved in accordance with the principles of the present invention with an electrophotographic image forming device having a photoconductive drum. A charging unit electrically charges an outer surface of the photoconductive drum. An exposing unit forms an electrostatic latent image on the outer surface of the photoconductive drum. A developing unit provides toner to the outer surface of the photoconductive drum to form a toner image. A copying roller copies the toner image from the outer surface of the photoconductive drum to a recording sheet. A toner container is installed within the photoconductive drum for storing the toner. A first hole is formed in a lower portion of the toner container. A cleaning unit removes and collects the toner remaining on the outer surface of the photoconductive drum after an image forming operation is performed. A second hole is formed in a lower portion of the cleaning unit. A first auger is installed within the toner container for transferring the toner in a first direction. A first driving gear is installed at an end of said first auger for rotating the first auger. A second auger is installed below the first hole for receiving the toner from the toner container via the first auger, and transferring the toner to the developing unit. A third auger is installed within an interior of the developing unit for transferring the toner received from the second auger to a supply roller of the developing unit. A second driving gear is installed at an end of the third auger for rotating the third auger. A fourth auger is installed within the cleaning unit for transferring the toner in the first direction. A third driving gear is installed at an end of the fourth auger for rotating the fourth auger. A fifth auger is installed below the second hole for receiving the toner from the cleaning unit via the fourth auger, and transferring the toner to the second auger. The second auger transfers the toner received via the fifth auger to the developing unit.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings, wherein:

FIG. 1 is a schematic view of a conventional electrophotographic image forming device;

DETAILED DESCRIPTION OF THE INVENTION

Figure 2:
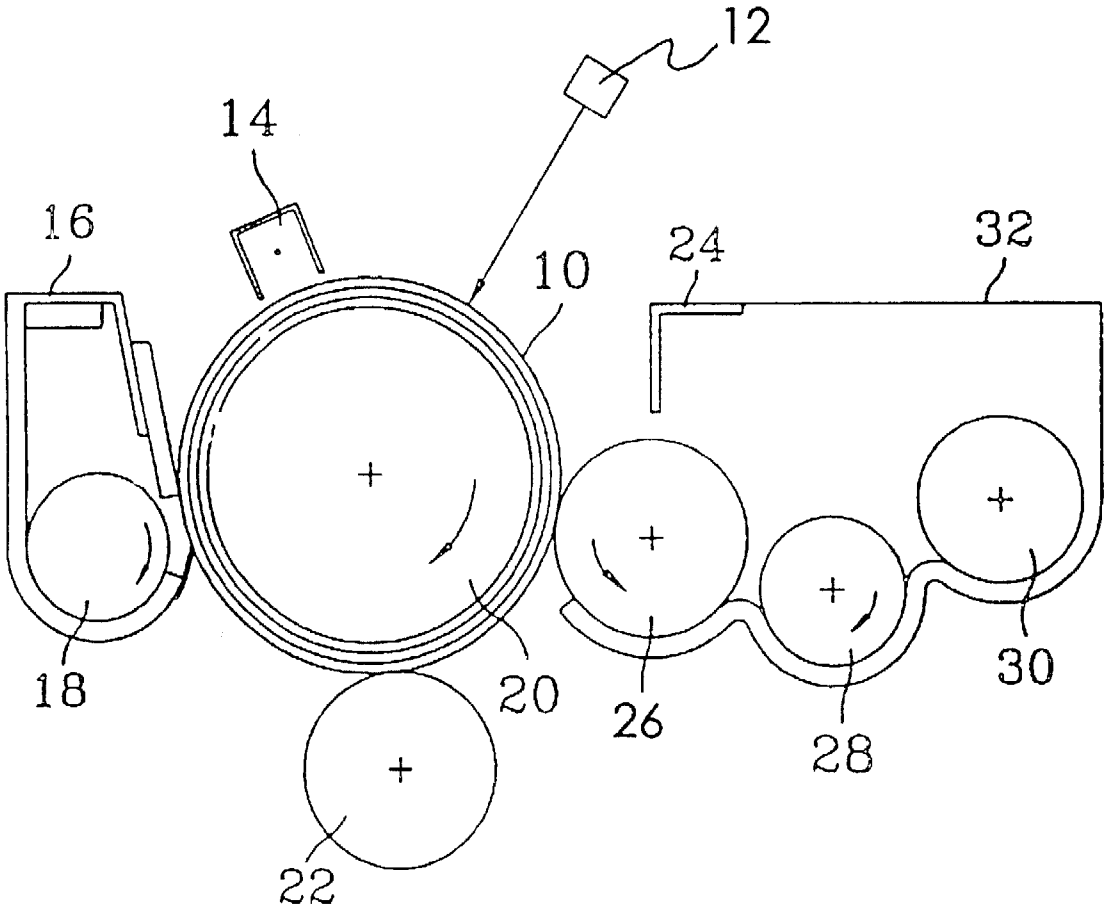
FIG. 2 is a schematic view of an electrophotographic image forming device constructed according to the principles of the present invention.

Turning now to the drawings and referring to FIG. 1, a schematic view of a conventional electrophotographic image forming device is shown. In FIG. 1, a photoconductive drum 60 rotates clockwise at a constant speed while a charging unit 64 installed at an upper portion of photoconductive drum 60 uniformly charges the surface of photoconductive drum 60 with an electrical charge layer. An exposing unit 62 forms an electrostatic latent image on the electrically charged surface of photoconductive drum 60, and a developing unit 66 installed on one side of photoconductive drum 60 forms an image of toner 68 on the surface of photoconductive drum 60. A toner container 69 is installed on one side of developing unit 66 for storing the toner 68.

An agitator 70 installed within toner container 69 agitates and transfers the toner 68. A supply roller 72 installed on one side of agitator 70 supplies the agitated toner 68 to a developing roller 74. Developing roller 74 provides toner 68 onto the electrostatic latent image formed on the surface of photoconductive drum 60. A doctor blade 76 installed at an upper portion of developing roller 74 ensures that toner 68 is formed on a surface of developing roller 74 at a uniform height.

A copying roller 78 is installed at a lower portion of photoconductive drum 60 copies the image of toner 68 from the surface of photoconductive drum 60 to a recording sheet. A cleaning unit 82 installed on one side of photoconductive drum 60 removes excess toner 68 remaining on the surface of photoconductive drum 60. Cleaning unit 82 includes a toner container 80 for storing the excess toner 68 removed from the surface of photoconductive drum 60.

The operation of the electrophotographic image forming device of FIG. 1 is as follows.

The surface of photoconductive drum 60 is electrically and uniformly charged by a corona discharge of charging unit 64. When the surface of photoconductive drum 60 is exposed by image-carrying light provided from exposing unit 62, an electrostatic latent image is formed on the outer surface of photoconductive drum 60 as it rotates. Simultaneously, toner 68 stored in toner container 69 is agitated by agitator 70 to be electrically uniform. The agitated toner 68 is supplied to developing roller 74 via supply roller 72. The toner 68 formed on the surface of developing roller 74 is uniformly regulated to a constant height by doctor blade 76.

Next, toner 68 is applied to the electrostatic latent image formed on photoconductive drum 60 while the photoconductive drum 60 passes developing roller 74, thereby creating a visible toner image. Subsequently, the toner image on the surface of photoconductive drum 60 is transferred to the recording sheet by high pressure. Then, the transferred recording sheet passes between a heating roller (not shown) and a pressing roller (not shown) of a fixing unit, and the toner image is permanently fused onto the recording sheet from heat and pressure. The printed sheet is then transferred to a stacker. The toner 68 remaining on the surface of photoconductive drum 60 after the image forming operation is removed by cleaning unit 82, and the removed toner 68 is collected in toner container 80.

In the above method, however, since the toner 68 removed and collected by cleaning unit 82 cannot be reused, the cost for toner increases. Also, the toner container 80 occupies an unnecessary amount of space, and the used toner remaining within the toner container 80 can contaminate the interior of the image forming device.

Figure 3A:
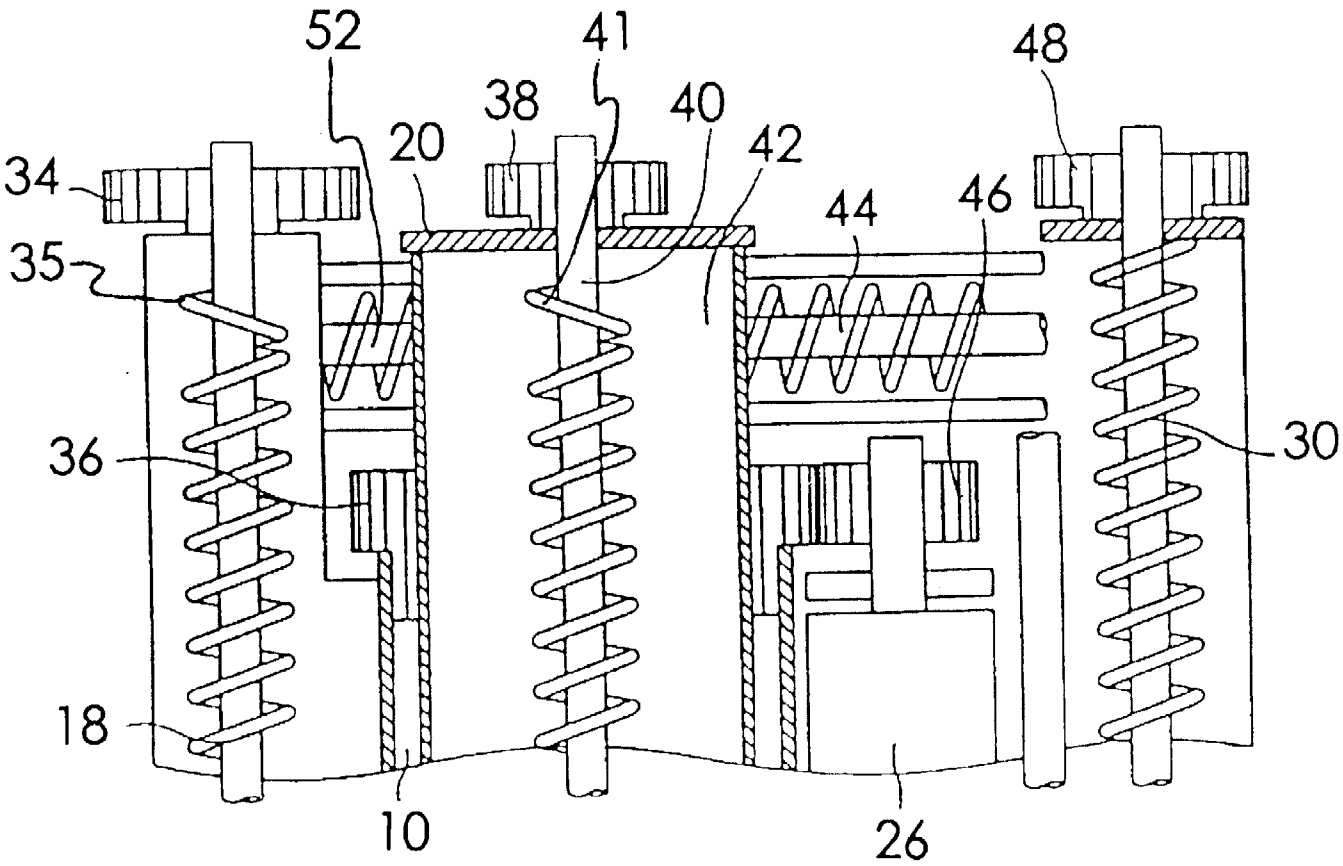
FIGS. 3A and 3B are cross-sectional views of the electrophotographic image forming device constructed according to the principles of the present invention.
Figure 3B:
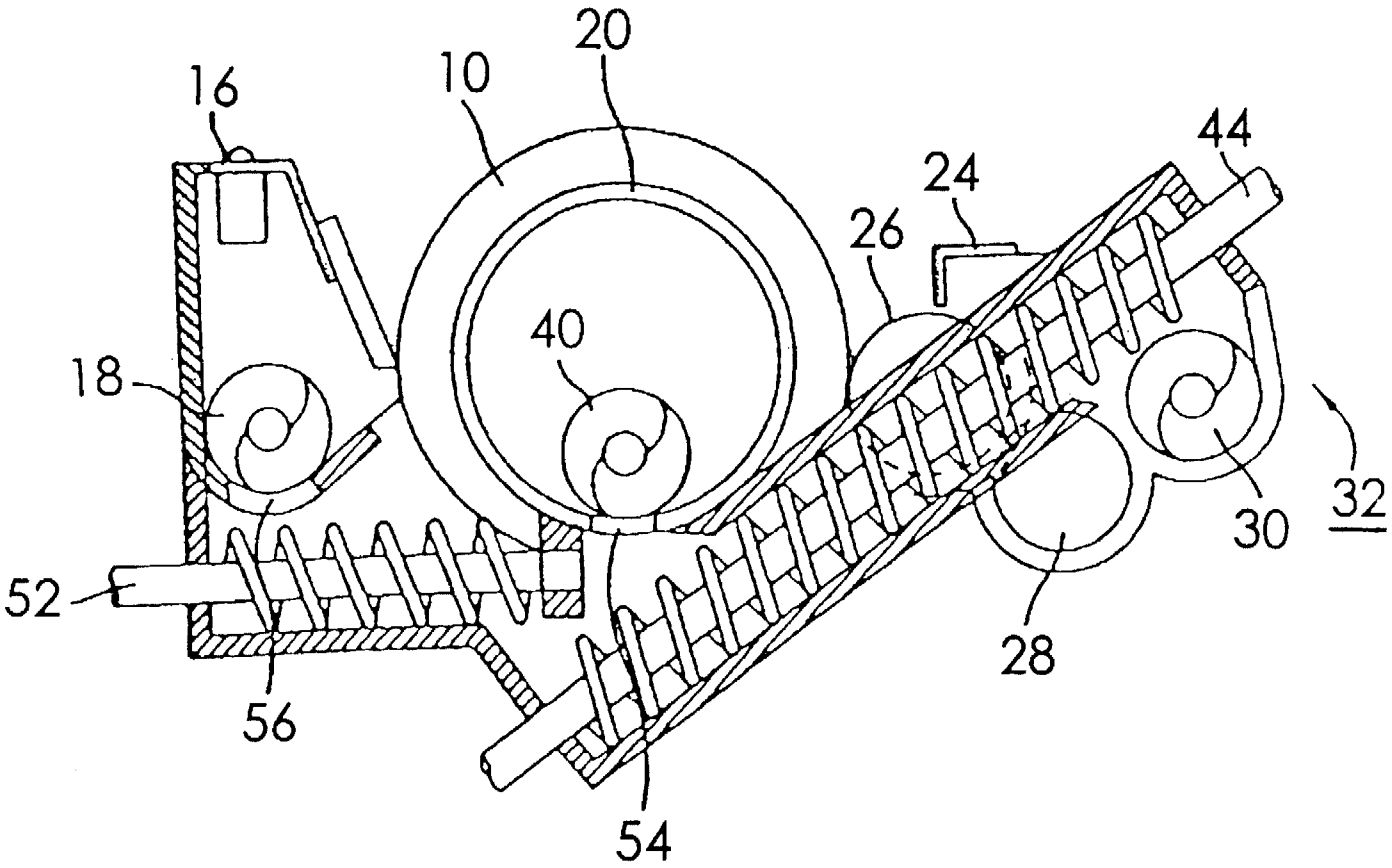

Referring to FIGS. 2 through 3B, schematic and cross-sectional views of an electrophotographic image forming device constructed according to the principles of the present invention are shown. In FIGS. 2 through 3B, a photoconductive drum 10 rotates at a constant speed, and a toner container 20 is installed inside photoconductive drum 10 for storing toner 42. A first auger 40 is installed inside toner container 20 for transferring toner 42 in one direction. A wing 41 is formed on one side of first auger 40, and is oriented to prevent an accumulation and hardening of toner 42 stored within toner container 20 by the rotation of first auger 40. A first hole 54 is formed in toner container 20 at the wing 41 of first auger 40 for providing transfer of toner 42 to a second auger 44 installed below first hole 54. Second auger 44 is slanted in order to transfer the toner 42 provided from toner container 20 to a developing unit 32. A first driving gear 38 is installed at an end of first auger 40 for driving (i.e., rotating) first auger 40. A charging unit 14 is installed at an upper portion of photoconductive drum 10 for uniformly charging the surface of photoconductive drum 10. An exposing unit 12 is also installed at the upper portion of photoconductive drum 10 for forming an electrostatic latent image on the surface of photoconductive drum 10. Developing unit 32 is installed on one side of photoconductive drum 10 for forming an image of toner 42 on the surface of photoconductive drum 10. A third auger 30 is installed on one side of the interior of developing unit 32 for transferring toner 42 received from second auger 44 to a supply roller 28. One surface of third auger 30 is slanted so as to uniformly supply toner 42 to supply roller 28. A second driving gear 48 is installed at one end of third auger 30 for driving third auger 30. Supply roller 28, which is installed on one side of third auger 30, supplies toner 42 to a developing roller 26. Developing roller 26 is installed on one side of supply roller 28 for transferring toner 42 onto the electrostatic latent image formed on the surface of photoconductive drum 10. A doctor blade 24 is installed at an upper portion of developing unit 32 for ensuring that toner 42 is formed on the surface of developing roller 26 at a uniform height. A copying roller 22 installed at a lower portion of photoconductive drum 10 copies the image of toner 42 from the surface of photoconductive drum 10 to a recording sheet. A cleaning unit 16 installed on one side of photoconductive drum 10 removes and collects excess toner 42 remaining on the surface of photoconductive drum 10. A fourth auger 18 is installed inside cleaning unit 16 for transferring the removed toner 42 in one direction. A wing 35 is formed on one side of fourth auger 18 with an orientation to prevent an accumulation and hardening of the toner 42 stored within cleaning unit 16 by the rotation of fourth auger 18. A second hole 56 is formed in a lower portion of cleaning unit 16 for providing the transferred toner 42 to a fifth auger 52. A third driving gear 34 is installed at one end of fourth auger 18 for driving fourth auger 18. In this configuration, the first, second and third driving gears 38, 48 and 34 operate together to maintain a uniform supply of toner 42. Also, a fourth driving gear 36 is provided for driving photoconductive drum 10, and a fifth driving gear 46 is provided for driving developing roller 26.

Fifth auger 52, which is installed below second hole 56, transfers collected toner 42 to second auger 44, and second auger 44 transfers the toner 42 to developing unit 32. Accordingly, the toner 42 collected by cleaning unit 16 can be used together with new toner. The amount of toner 42 initially stored in toner container 20 corresponds to the life of photoconductive drum 10. That is, toner container 20 is designed so that its supply of toner 42 becomes depleted at the same time photoconductive drum 10 is to be replaced.

The operation of the electrophotographic image forming device of FIGS. 2 through 3B is as follows.

The outer surface of photoconductive drum 10 is uniformly charged by a corona discharge provided from charging unit 14. Once charged, the outer surface of photoconductive drum 10 is exposed to image-carrying light output from exposing unit 12, and an electrostatic latent image is thereby formed on the outer surface of photoconductive drum 10. Simultaneously, toner 42 from toner container 20 installed within photoconductive drum 10 is transferred in one direction by the rotation of first auger 40, and is provided to second auger 44 through first hole 54. This toner 42 is then transferred to third auger 30 by the rotation of second auger 44.

Next, third auger 30 transfers a predetermined amount of toner 42 to supply roller 28, and supply roller 28 in turn provides the toner 42 to developing roller 26. Doctor blade 24 installed at the upper portion of developing unit 32 ensures that the toner 42 is formed on the surface of developing roller 26 at a uniform height. To convert the electrostatic latent image to a visible toner image, developing roller 26 applies toner 42 to the outer surface of photoconductive drum 10. The toner image on the outer surface of photoconductive drum 10 is then copied onto a recording sheet by high pressure applied from copying roller 22.

The recording sheet bearing the toner image is next transferred between a heating roller and a pressure roller of a fixing unit to thereby permanently fuse the toner image onto the recording sheet. The printed recording sheet is then transferred to a stacker. In the meantime, residual toner 42 remaining on the outer surface of photoconductive drum 10 is removed by cleaning unit 16. The removed toner 42 is transferred in one direction by the rotation of fourth auger 18, and is thereby provided to fifth auger 52 through second hole 56. This used toner 42 is transferred to second auger 44 by the rotation of fifth auger 52, and is then transferred to third auger 30 along with new toner by the rotation of second auger 44. Accordingly, the used toner 42 and the new toner 42 are combined together in developing unit 32.

According to the electrophotographic image forming device of the present invention, toner 42 that is removed and collected by a cleaning unit 16 can be reused, thus reducing the overall cost expended on toner. Also, since the toner container 20 is installed inside the photoconductive drum 10, the image forming device becomes more compact and installation space is not restricted when the developing unit 32 is installed within the device. Further, since used toner is re-used, contamination of the interior of the image forming device is prevented.

While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the central scope thereof. Therefore, it is intended that the present invention not be limited to the particular embodiments disclosed as the best mode contemplated for carrying out the present invention, but that the present invention includes all embodiments falling within the scope of the appended claims.

What is claimed is:

1. An electrophotographic image forming device, comprising:

a photoconductive drum;

a charging unit for electrically charging an outer surface of said photoconductive drum;

an exposing unit for forming an electrostatic latent image on the outer surface of said photoconductive drum;

a developing unit for providing toner to the outer surface of said photoconductive drum to form a toner image;

a copying roller for copying the toner image from the outer surface of said photoconductive drum to a recording sheet;

a toner container installed within said photoconductive drum for storing the toner, said toner container having a first hole formed in a lower portion thereof, a cleaning unit for removing and collecting the toner remaining on the outer surface of said photoconductive drum after an image forming operation is performed, said cleaning unit having a second hole formed in a lower portion thereof;

a first auger installed within said toner container for transferring the toner in a first direction;

a first driving gear installed at an end of said first auger for rotating said first auger;

a second auger installed below said first hole for receiving the toner from said toner container via said first auger, and transferring the toner to said developing unit;

a third auger installed within an interior of said developing unit for transferring the toner received from said second auger to a supply roller of said developing unit;

a second driving gear installed at an end of said third auger for rotating said third auger;

a fourth auger installed within said cleaning unit for transferring the toner in said first direction;

a third driving gear installed at an end of said fourth auger for rotating said fourth auger; and a fifth auger installed below said second hole for receiving the toner from said cleaning unit via said fourth auger, and transferring the toner to said second auger, said second auger transferring the toner received via said fifth auger to said developing unit.

2. An electrophotographic image forming device as claimed in claim 1, wherein said second auger is slanted to supply the toner to said developing unit.

3. An electrophotographic image forming device as claimed in claim 1, wherein said first, second and third driving gears operate together to maintain a uniform supply of the toner.

4. An electrophotographic image forming device as claimed in claim 1, further comprising a wing formed on one side of said first auger for preventing accumulation and hardening of the toner within said toner container by rotation of said first auger.

5. An electrophotographic image forming device as claimed in claim 1, further comprising a wing formed on one side of said fourth auger for preventing accumulation and hardening of the toner within said cleaning unit by rotation of said fourth auger.

6. An electrophotographic image forming device as claimed in claim 1, wherein an amount of the toner stored in said toner container corresponds to a life of said photoconductive drum so that the toner within said toner container is depleted when said photoconductive drum is to be replaced.

7. An electrophotographic image forming device as claimed in claim 1, wherein the toner collected by said cleaning unit is combined together with new toner in said developing unit.

8. An electrophotographic image forming device, comprising:

a photoconductive drum;

a toner container installed within said photoconductive drum for storing toner, said toner container having a first hole formed in a lower portion thereof;

a developing unit for providing the toner to an outer surface of said photoconductive drum to form a toner image;

a cleaning unit for removing and collecting the toner remaining on the outer surface of said photoconductive drum after an image forming operation is performed, said cleaning unit having a second hole formed in a lower portion thereof;

a first auger installed within said toner container for transferring the toner in a first direction;

a second auger installed below said first hole for receiving the toner from said toner container via said first auger, and transferring the toner to said developing unit;

a third auger installed within an interior of said developing unit for transferring the toner received from said second auger to a supply roller of said developing unit;

a fourth auger installed within said cleaning unit for transferring the toner in said first direction; and a fifth auger installed below said second hole for receiving the toner from said cleaning unit via said fourth auger, and transferring the toner to said second auger, said second auger transferring the toner received via said fifth auger to said developing unit.

9. An electrophotographic image forming device as claimed in claim 8, wherein said second auger is slanted to supply the toner to said developing unit.

10. An electrophotographic image forming device as claimed in claim 9, wherein an amount of the toner stored in said toner container corresponds to a life of said photoconductive drum so that the toner within said toner container is depleted when said photoconductive drum is to be replaced.

11. An electrophotographic image forming device as claimed in claim 10, wherein the toner collected by said cleaning unit is combined together with new toner in said developing unit.

12. An electrophotographic image forming device as claimed in claim 8, wherein an amount of the toner stored in said toner container corresponds to a life of said photoconductive drum so that the toner within said toner container is depleted when said photoconductive drum is to be replaced.

13. An electrophotographic image forming device as claimed in claim 8, wherein the toner collected by said cleaning unit is combined together with new toner in said developing unit.

14. A method for transferring toner in an electrophotographic image forming device, comprising the steps of:

rotating a first auger to output toner from a toner container positioned within a photoconductive member of said device;

rotating a second auger to transfer the toner output from said tone container to a developing unit of said device;

rotating a third auger to enable transfer of the toner from said developing unit to said photoconductive member to perform an image forming operation;

collecting the toner remaining on said photoconductive member within a cleaning unit after said image forming operation is performed;

rotating a fourth auger to output the toner from said cleaning unit;

rotating a fifth auger to transfer the toner output from said cleaning unit to said second auger; and rotating said second auger to transfer the toner received via rotation of said fifth auger to said developing unit.

* * * * *